US005314384A

United States Patent [19]

Ross-Sullivan

[11] Patent Number: 5,314,384

[45] Date of Patent: May 24, 1994

[54] COLLAPSABLE RAMP FOR PROJECTING BOWLING BALLS

[76] Inventor: Mark Ross-Sullivan, 580 Mercedes Ave., Pasadena, Calif. 91107

[21] Appl. No.: 978,585

[22] Filed: Nov. 19, 1992

[51] Int. Cl.[5] ..... A63D 5/00

[52] U.S. Cl. ..... 473/55; 273/129 Q

[58] Field of Search ..... 273/54 R, 54 D, 129 Q

[56] References Cited

U.S. PATENT DOCUMENTS

| | | | |
|---|---|---|---|
| 2,473,087 | 6/1949 | Almasi | 273/129 Q |
| 3,159,401 | 12/1964 | Ikenberry | 273/54 R |
| 4,097,045 | 6/1978 | Bechtel | 273/54 R |
| 4,286,784 | 9/1981 | Harvey et al. | 273/54 D |
| 4,368,898 | 1/1983 | Lay | 273/54 R |

*Primary Examiner*—Vincent Millin
*Assistant Examiner*—William M. Pierce
*Attorney, Agent, or Firm*—John J. Posta, Jr.

[57] ABSTRACT

The child's bowling aid device resembles a portable bowling ball holding rack with attached bowling ball launching ramp and is adapted to permit a child to easily hold the bowling ball on the rack and then ease it forward off the rack through the launching ramp, after aiming the ramp, in order to roll it onto a bowling lane and knock down bowling pins. The device includes first and second spaced parallel vertical side plates, each with a flat bottom, elevated rear end, a dish-shaped bowling ball-retaining top portion and a front top portion which slopes down and forwardly to serve as a launching ramp. Spaced rear and front transverse vertical crossplates interconnect the side plates. The rear transverse plate is taller than the front transverse plate. Preferably, all plates are flat and releasably connectable and form a kit capable of being transported in disassembled condition in a bag or the like and then being assembled at a bowling alley for use. Preferably each plate is light in weight and the side plates bear finger grooves to facilitate movement of the assembled device into aimed position adjacent a bowling lane. An improved method of aiding a child in learning to bowl involves the use of the device with a bowling ball in a game simulating conventional bowling.

8 Claims, 2 Drawing Sheets

COLLAPSABLE RAMP FOR PROJECTING BOWLING BALLS

BACKGROUND OF THE INVENTION

1. Field of the Invention

The present invention generally relates to sports devices and more particularly to a device specifically designed to aid a child in learning to bowl.

2. Prior Art and Discussion

Bowling is a favorite year-round pastime and is particularly popular at those times of the year and in those portions of the country which have habitual inclement weather, since bowling is usually performed indoors in sheltered lanes.

Bowling involves the use of a relatively large and heavy ball which is hard for youngsters to lift and throw, even if made of lighter weight material than normal. It is an impossibility for very young children who would like to participate in the sport but cannot either lift or throw the ball.

There remains a need for an improved child's bowling aid device which will help the child to be able to bowl and thus learn its general techniques, rules and form. Such device should provide the means for supporting the heavy bowling ball, permit it to be aimed by the child and facilitate its release towards the target, the ten pins at the far end of the bowling lane. Such device should be sturdy, inexpensive, easy to assemble, disassemble and use and easy to aim.

SUMMARY OF THE INVENTION

The improved child's bowling aid device of the present invention satisfies all the foregoing needs. The device can be provided in assembled or kit form, is portable, inexpensive, durable, easily aimed, efficient and enjoyable to use. It is preferably used in the method of the present invention which is directed to aiding a child in learning to bowl.

The device is substantially as set forth in the Abstract of the Disclosure. Thus, the device comprises a spaced, vertical parallel pair of side plates, the lower ends of which are flat so that the device can be easily slid into an aiming position adjacent the head of a bowling lane. The tops of the side plates are configured to provide a raised rear portion, an intermediate dished portion which acts as a bowling ball retainer and a downwardly and forwardly sloped chute or launching ramp for the bowling ball.

The device also includes rear and front transverse upright brace plates which stabilize the device, holding the sides plates in parallel relation. A bottom transverse brace plate may also be provided in the device to increase such stabilization. Preferably, the side plates and transverse plates are provided with a series of slots and grooves so that the plates can be flat and can be provided in kit form for easy transport to and assembly and disassembly at the bowling lanes.

When the bowling ball is to be bowled in playing the game, the device is first slid into proper aiming position at the head of the bowling lane so that when the ball is launched therefrom it will proceed directly down the lane and knock over the ten pins at the far end of the lane. Next, the bowling ball is urged forward from its cradled resting position in the dish-shaped intermediate portion of the top of the device to the forward sloped launching ramp, down which it accelerates and comes out onto the bowling lane and speeds down the lane for the desired bowling effect.

With the use of the device, a child of tender years, with assistance, can bowl and learn to score and thoroughly enjoy the game. By positioning the device at different angles top the longitudinal axis of the bowling lane, the child can learn the effect of the ball hitting the ten pin array at different pocket sites and thus fix in his or her mind the "sweet spots" needed to be hit in order to knock down all the pins.

The method of the present invention involves the use of the above-described device in the procedure set forth above in order to learn and bowl. Further features of the present invention are set forth in the following detailed description and accompanying drawings.

DRAWINGS

DETAILED DESCRIPTION

Figure 1:
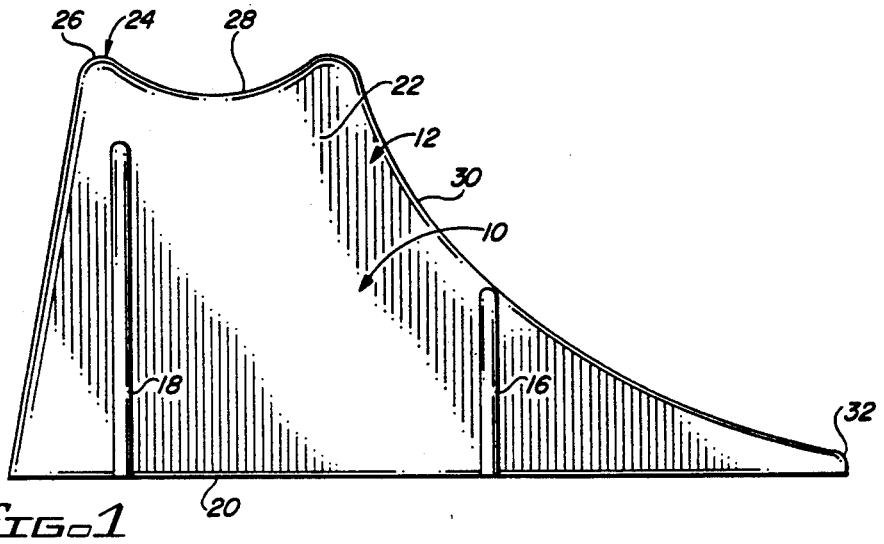
FIG. 1 is a schematic side elevation of a preferred embodiment of the improved child's bowling aid device of the present invention.
Figure 2:
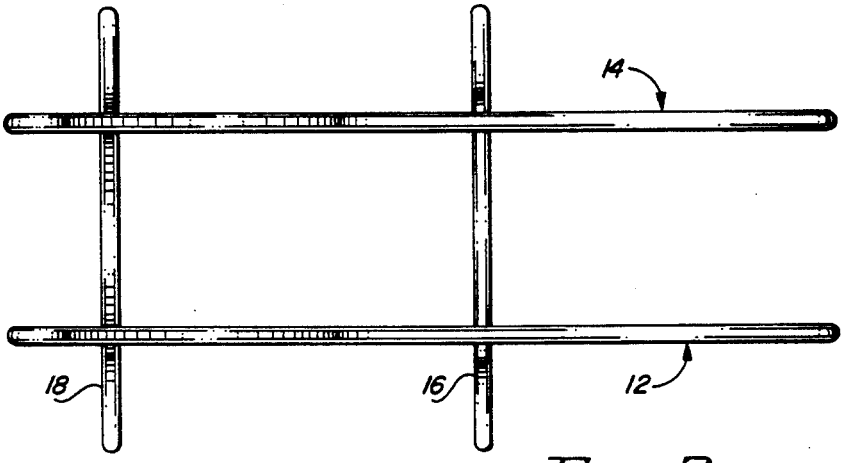
FIG. 2 is a schematic top plan view of the device of FIG. 1; to roll it onto a bowling lane and knock

FIGS. 1-6.

Now referring more particularly to FIGS. 1-6 of the drawings, a preferred embodiment of the improved child's bowling aid device of the present invention is schematically depicted therein. Thus, device 10 is depicted therein. Device 10 comprises, in combination, a spaced, parallel, vertical pair of flat side plates 12 and 14 held in the described parallel relation by spaced rear and front transverse crossplates 16 and 18.

Side plates 12 and 14 each include a flat horizontal bottom 20, vertical sidewall 22 and a specially configured top 24. The rear end portion 26 of top 24 is raised. An intermediate dish-shaped portion 28 is integrally connected thereto and is adapted to serve as a bowling ball cradle. The front portion 30 of top 24 begins at the front end of intermediate portion 28 and comprises a downwardly and forwardly curved ramp or launching chute for a bowling ball, the front end 32 of which terminates slightly above bottom 20.

Side plates 12 and 14 are flat as are crossplates 16 and 18. All plates are preferably releasably interconnectable with each other so that they can be carried flat in a bag to form a kit which can be assembled at a bowling lane and just as easily disassembled.

Crossplate 16 is generally lower than crossplate 18 and both are generally vertical and generally frustotriangular when viewed in elevation. Thus, crossplate 16 has a flat horizontal bottom 34, upraised coverging sides 36 and 38 and a flat horizontal top 40 which includes spaced side portions 42 and 44 separated by a central lower rectangular portion 46 defined by spaced vertical slots 48 and 50 which begin at top 40 and terminate at their lower ends in continuous internal and external grooves 52 and 54, respectively. Portion 46 is preferably provided on its exterior surface 56 with a finger slot 58 to aid in lifting device 10.

Figure 3:
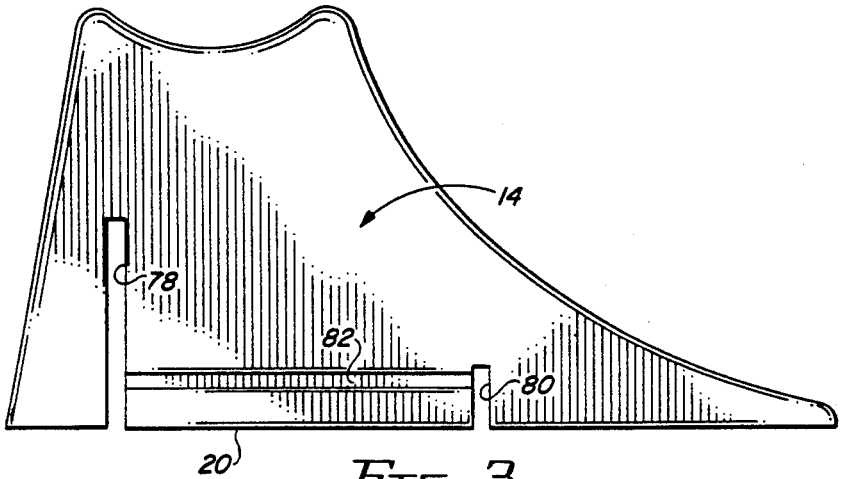
FIG. 3 is a schematic side elevation of the inner surface of one of the vertical side plates of the device of FIG. 1.
Figure 4:
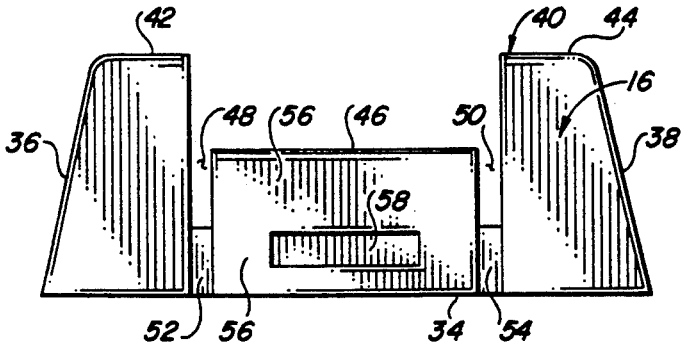
FIG. 4 is a schematic front elevation of the front transverse crossplate of the device of FIG. 1.
Figure 5:
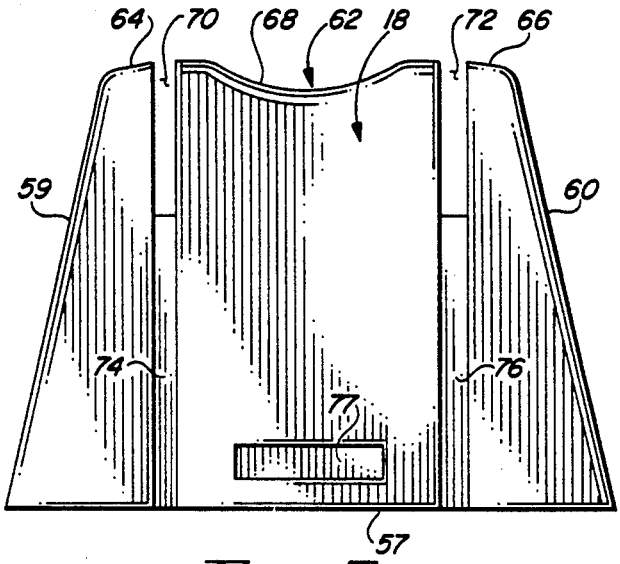
FIG. 5 is a schematic rear elevation of the rear transverse crossplate of the device of FIG. 1; and, FIG. 6 is a schematic side elevation of the inner surface of the other of the two side plates.

Crossplate 18 is similar to but taller than cross-plate 16. Crossplate 18 has a flat horizontal bottom 57, upwardly converging sides 59 and 60 and configured top 62. Top 62 has generally flat side portions 64 and 66 separated from dish-shaped central portion 68 by vertical slots 70 and 72 beginning at top 62 and running down to continuous internal and external grooves 74 and 76, respectively, which terminate at bottom 57. An external finger groove 77 aids in lifting device 10. As seen in FIG. 3, side plate 14 has a rear vertical slot 78 which extends up partway from bottom 20 and a front vertical slot 80 which also extends up from bottom 20 and is shorter than slot 78. Slots 78 and 80 are bridged by an optional horizontal groove 82 on its inner surface adapted to releasably receive one end of a transverse optional bottom brace plate (not shown).

Figure 6:
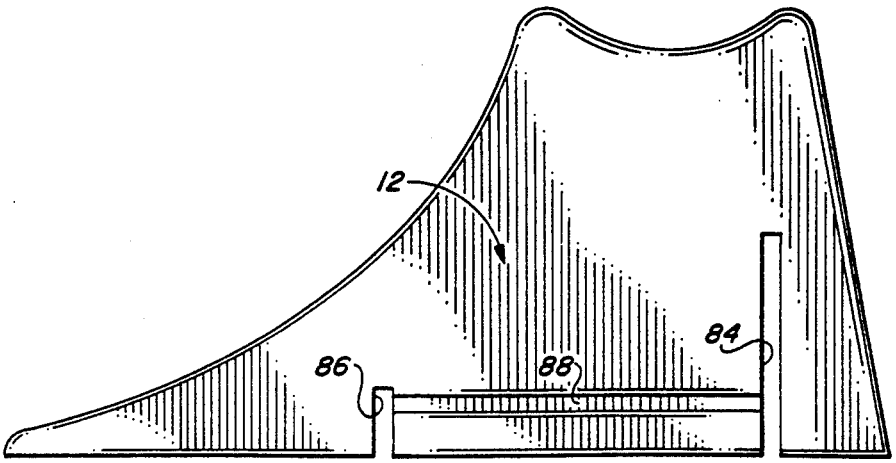

Side plate 12 is a mirror image of side plate 14, as shown in FIG. 6, having a long rear vertical slot 84, a short front vertical slot 86 and an optional horizontal groove 88 on its inner surface. The described grooves and slots for plates 12 and 14 are dimensioned and positioned to match each other.

In assembling device 10, slot 50 and grooves 54 of crossplate 16 are engaged with slot 80 of side plate 14; slot 48 and grooves 52 of crossplate 16 are engaged with slot 86 of side plate 12; slot 70 and grooves 74 of crossplate 18 are engaged with slot 78 of side plate 14; and, slot 72 and grooves 76 of crossplate 18 are engaged with slot 84 of side plate 12. Thus, device 10 can be easily assembled and disassembled, carried and stored, as desired. It is understood that, if desired, all plates described herein could be permanently secured together, as by gluing, nailing, screwing, or the like. However, it is preferable to have device 10 in the form of an easily assemblable and disassemblable kit.

In accordance with the present method, as described above in the Summary of the Invention, a bowling ball is placed on the device of the present invention in intermediate portion 28 of top 24 and is then urged forward thereof unto front ramp portion 30 of top 24 after device 10 is aligned with ten pins (at the rear end of a bowling lane). For this purpose, device 10 is placed at the head of a bowling lane. Once the bowling ball is on ramp portion 30, it rolls freely down to the bowling lane and is automatically bowled. Thus, a small child can bowl without having to either lift, hold or throw a bowling ball down a bowling lane.

Various modifications can be made in the improved device of the present invention, its components and their parameters. All such modifications, alterations and additions as are within the scope of the appended claims form part of the present invention.

What is claimed is:

1. An improved, portable, child's bowling aid device, said device comprising, in combination:

a) first and second vertical side plates, each of said side plates having 1) a flat horizontal bottom extending along its length 2) an undulating top, including:

i) means for releasably retaining a bowling ball on said device, including a rear dish-shaped bowling ball-retaining top portion, and ii) a front portion which slopes from said rear top portion to the forward end of said bottom, b) a rear transverse vertical crossplate connected to said first and second vertical side plates adjacent the rear end of said side plates and holding said side plates in spaced parallel relation, said rear cross plate having each end thereof extending a distance from each respective vertical side plate to provide stability to said device, c) a front transverse vertical crossplate shorter than said rear transverse vertical crossplate and connected to said first and second vertical side plates adjacent the front end of said side plates and holding said side plates in spaced parallel relation, said device being adapted to received and cradle a bowling ball on said top rear portion after positioning said device at a predetermined position on a bowling lane and permitting said bowling ball to be moved forward from its resting position and to be easily rolled down said slope for bowling said ball onto a bowling lane from said predetermined position.

2. The improved child's bowling aid device of claim 1 wherein all of said plates are releasably connected to each other, so that device forms a kit which can be carried to a bowling site, assembled, then used, disassembled and carried from said site.

3. The improved child's bowling aid device of claim 2 wherein said plates comprise at least one of wood, metal, plastic, ceramic and hardened rubber.

4. The improved child's bowling aid device of claim 2 wherein said first and second vertical side plates are substantially identical and bear an elongated vertical rear slot for reception of said rear crossplate and a shorter vertical front slot spaced forwardly of said rear slot for reception of said front crossplate.

5. The improved child's bowling aid device of claim 4 wherein said first and second vertical side plates each define on their inner surfaces a horizontal groove between said slots and adjacent the bottom of said side plates and wherein a transverse horizontal brace plate spans said plates and releasably fits into said grooves.

6. The improved child's bowling aid device of claim 4 wherein said rear vertical crossplate is frusto-triangular, the upper end thereof having a dished central section and wherein said rear vertical crossplate defines a spaced pair of vertical grooves, said grooves terminating at their upper ends in vertical slots which extend up to said upper end of said rear vertical crossplate and which facilitate reception of said side plates therein.

7. The improved child's bowling aid device of claim 6 wherein said rear vertical crossplate defines on the outer surface thereof a finger-receiving recess to facilitate lifting said device.

8. The improved child's bowling aid device of claim 7 wherein said front vertical crossplate is frusto-triangular and defines a spaced vertical pair of grooves from the lower end thereof which terminate at their upper ends in vertical slots extending to the upper end of said front crossplate, wherein the upper portion of the central area of said front crossplate is cut away and wherein said front crossplate on the outer surface thereof defines a horizontal finger-receiving recess to facilitate lifting said device.

* * * * *